United States Patent [19]

Vollmer et al.

[11] Patent Number: 4,683,453

[45] Date of Patent: Jul. 28, 1987

[54] SOLENOID ACTUATOR WITH FASTENER

[75] Inventors: David J. Vollmer, Ironia; James E. Greame, Long Valley, both of N.J.

[73] Assignee: Automatic Switch Company, Florham Park, N.J.

[21] Appl. No.: 801,466

[22] Filed: Nov. 25, 1985

[51] Int. Cl.[4] ..... H01F 7/08

[52] U.S. Cl. ..... 335/255; 335/278

[58] Field of Search ..... 335/251, 255, 260, 278; 251/129.01, 129.21

[56] References Cited

U.S. PATENT DOCUMENTS

| | | | |
|---|---|---|---|
| 2,616,452 | 11/1952 | Clay et al. | 251/129.21 |
| 3,295,079 | 12/1966 | Brown | 335/278 X |
| 3,727,160 | 4/1973 | Churchill | 335/278 X |

*Primary Examiner*—George Harris

*Attorney, Agent, or Firm*—Alan H. Levine

[57] ABSTRACT

A solenoid actuator including a coil of electrically conductive wire wound about an axis, an enclosure for the coil, a receptacle carried by the enclosure for accommodating a mounting member of a device to be controlled by the solenoid actuator, a slideway carried by the enclosure extending transverse to the coil axis, and a fastener movable within the slideway for latching and unlatching the enclosed coil to the device to be controlled. The coil enclosure is a plastic encapsulation, the receptacle is an opening in a surface of the encapsulation, and the slideway is a chamber within the encapsulation intersecting the recess. The mounting member, which may be secured to a core tube within which the movable armature of the solenoid actuator is located, has an annular slot, and the fastener is a clip formed of sheet metal having edges which slide into the slot to latch the enclosed coil to the mounting member. The clip is formed with resilient detents for pressing the core tube against a stationary armature fixed within the solenoid coil. The clip is generally U-shaped, so that its arms straddle the mounting member, and the arms carry lugs which cooperate with shoulders within the slideway chamber to prevent complete removal of the clip from the slideway. The entry into the slideway is shaped to cooperate with the lugs so that the clip can be inserted into the slideway in only a single orientation.

11 Claims, 9 Drawing Figures

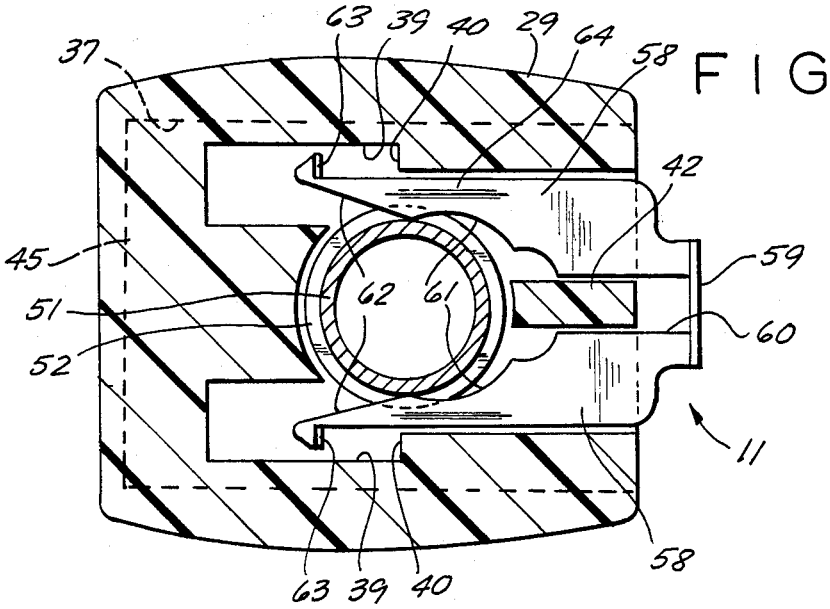
FIG. 6
FIG. 5
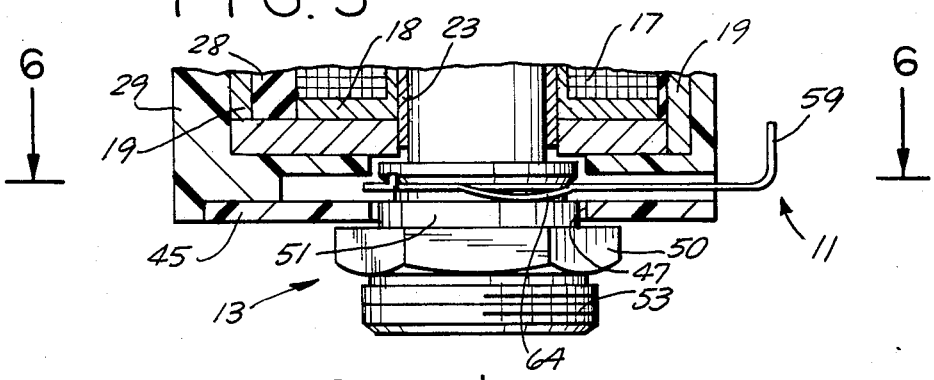
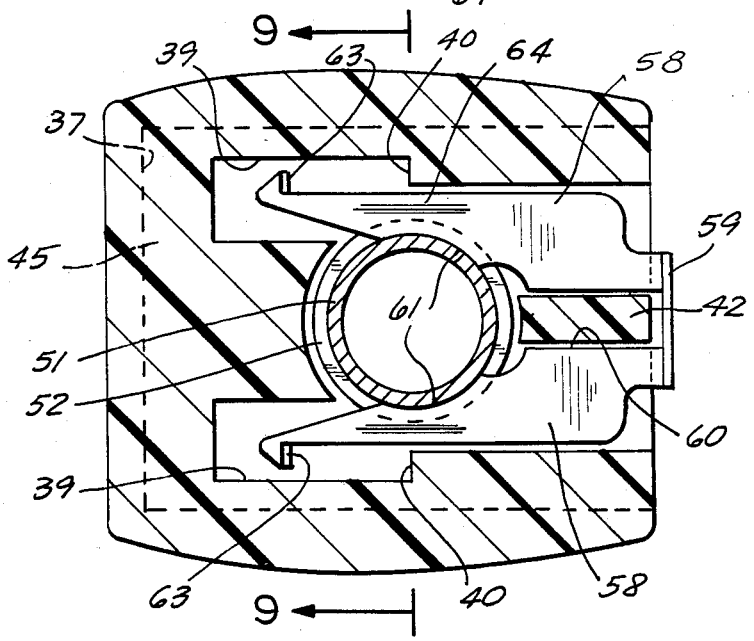
FIG. 8

SOLENOID ACTUATOR WITH FASTENER

This invention relates to solenoid actuators which are used to operate a wide variety of devices in response to electrical signals. For example, solenoid actuators are commonly used to open and close valves which control the flow of fluids.

Typically, a solenoid actuator includes a coil of electric wire, a steel yoke surrounding the coil to define a magnetic circuit, and a plastic encapsulation around the yoke and coil. At its center, the encapsulated coil has an axial hole for accommodating a core tube which contains a stationary armature and a movable armature which moves toward and away from the stationary armature in response to electrical signals received by the coil. The encapsulated coil is assembled with the core tube by slipping the coil over the core tube, so that the core tube extends through the hole in the coil, and a fastener is attached to the free end of the core tube to prevent disassembly of the coil from the tube. This fastener may be a threaded nut or some other type of fastener for fixing the coil to the tube. In most cases, a tool is required to attach the fastener to the core tube. Furthermore, since the fastener is a part separate from the encapsulated coil and the core tube, it is subject to being lost and not available when the parts are assembled.

It is an object of the present invention to provide a solenoid actuator which can be assembled with a core tube mounting means without the use of a tool.

It is another object of the invention to provide such a solenoid actuator wherein the fastener is permanently assembled with the coil so that it is always available when needed.

It is a further object of the invention to provide such a solenoid actuator wherein the fastener, in addition to securing the solenoid coil to the mounting member, presses the core tube into engagement with the stationary armature within the coil.

It is still another object of the invention to provide a solenoid actuator wherein the coil is encapsulated in plastic, the plastic encapsulation being formed with a slideway chamber for slidably accommodating a fastener in the form of a springy, sheet metal clip.

Additional objects and features of the present invention will be apparent from the following description, in which reference is made to the accompanying drawings.

In the drawings:

FIG. 5 is a view similar to a portion of FIG. 3 showing the fastener in a position between its latched and unlatched conditions;

FIG. 6 is a cross-sectional view taken along line 6—6 of FIG. 5;

FIG. 8 is a cross-sectional view taken along line 8—8 of FIG. 7.

A solenoid actuator chosen to illustrate the present invention includes an encapsulated coil and yoke 10 (FIG. 1) and a fastener 11, preferably in the form of a spring clip of sheet metal. The solenoid actuator cooperates with a core tube 12 permanently fixed to a mounting member 13.

Figure 3:
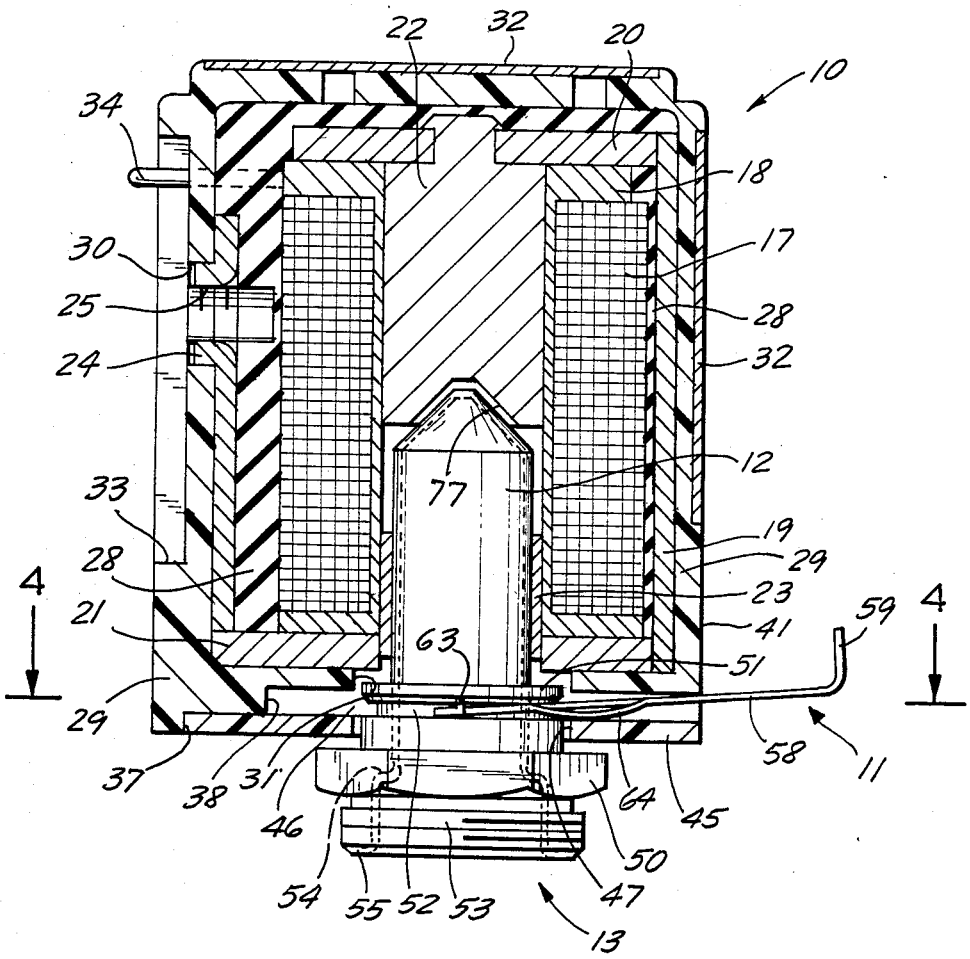
FIG. 3 is an axial cross-sectional view of the assembled encapsulated coil and core tube mounting arrangement with the fastener in its unlatched condition.
Figure 7:
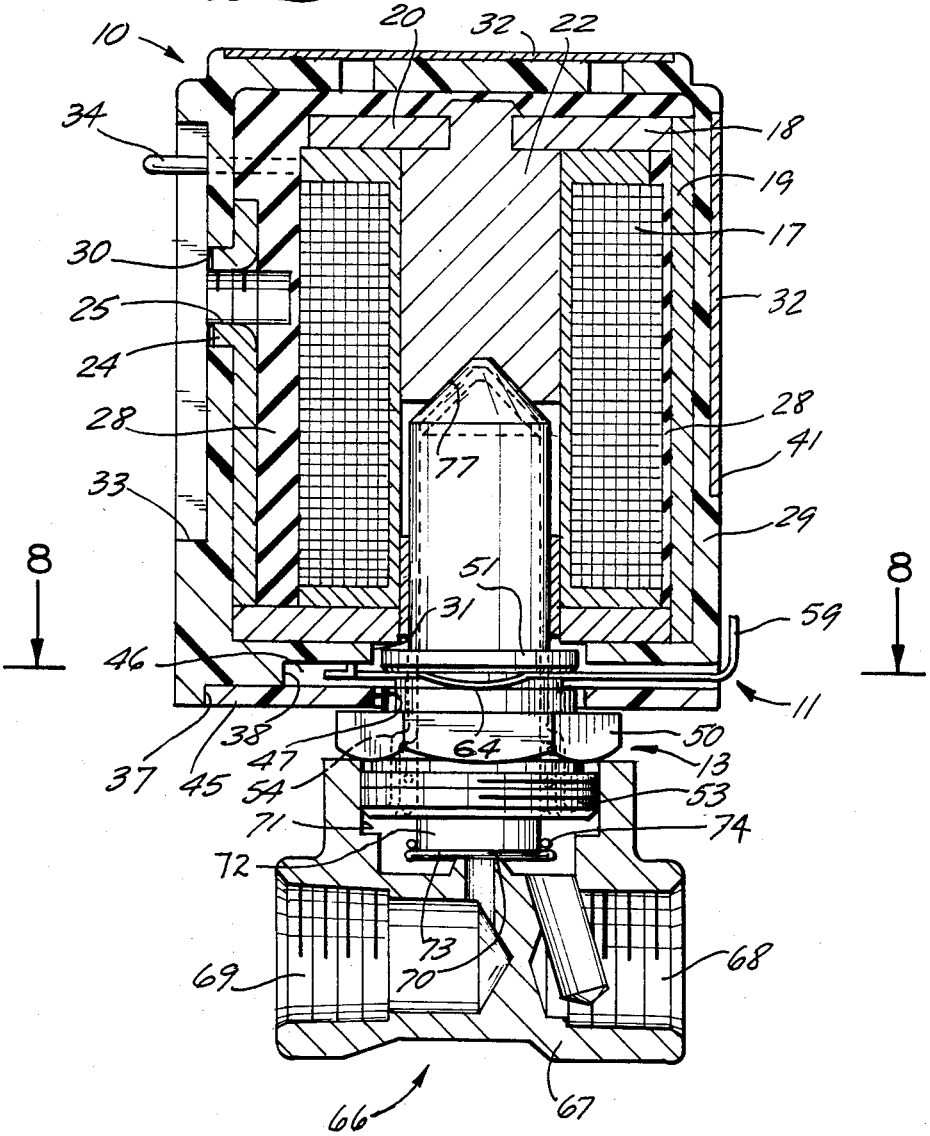
FIG. 7 is a view similar to FIG. 6 showing the fastener in its latched condition and the solenoid actuator mounted on a valve.

As shown in FIGS. 3 and 7, the encapsulated element 10 includes a coil 17 of electrically conductive wire wound upon a spool 18 of non-electrically and non-magnetically conductive material. Surrounding the coil and spool is a yoke of magnetic material, such as steel, including a side wall 19 extending around the entire periphery of coil 17, a top wall 20, and a bottom wall 21. A stationary armature 22, carried by top wall 20, extends into, and partially fills, the interior of spool 18. A tubular sleeve 23, carried by bottom wall 21, also extends into the interior of spool 18. At one point, side wall 19 of the yoke is formed with an outwardly projecting boss 24 surrounding an internally threaded hole 25.

Between side wall 19 of the yoke and the external surface of coil 17 is an inner encapsulation 28, formed of a suitable plastic material. Almost completely surrounding the yoke and coil is an outer encapsulation 29 also formed of a suitable plastic material. A hole 30 in the encapsulation is aligned with threaded hole 25, and another hole 31 in the encapsulation is coaxial with the axis of spool 18.

The outer encapsulation 29 may be formed, on its top and rear faces, with shallow recesses for accommodating plates or labels 32 which bear information about the characteristics of the solenoid, and perhaps a trademark and the trade name of the manufacturer. On its front face, encapsulation 29 may be formed with a deeper depression 33 (FIGS. 3 and 7) for accommodating an electrical connection module (not shown) used to connect the terminals 34 (only one being shown) of the coil to a source of electric power. Threaded hole 25 is adapted to receive a threaded bolt for securing the module to the solenoid arrangement.

On its bottom face, outer encapsulation 29 is formed with a rectangular depression 37 (FIGS. 3 and 7, and FIGS. 2, 4, 6, and 8). Within the confines of depression 37, encapsulation 29 is formed with a further depression 38 having a pair of side walls 39. Each side wall is formed with a jog to provide it with a shoulder 40. Depression 38 extends to the rear face 41 of encapsulation 29 (see FIG. 1), and between side walls 39 the encapsulation material is not removed so as to form a rib 42 extending into the recess from rear wall 41.

A flat plate 45 (FIGS. 3 and 7), which may be formed of the same material as encapsulation 29, fits snuggly within depression 37, and is fixed in that position, such as by a suitable adhesive. Plate 45, together with depression 38, forms a slideway chamber 46 for accommodating fastener 11. Plate 45 is formed with a hole 47 in registry with hole 31 in encapsulation 29. Holes 47 and 31, which are axially aligned with sleeve 23, define a receptacle for accommodating mounting member 13. It will be seen that slideway chamber 46 and the receptacle 47, 31 intersect each other.

Mounting member 13 includes a multi-sided flange 50 (FIGS. 1, 3, and 7) adapted to be engaged by a wrench. Above flange 50 is a cylindrical collar 51 formed with an annular slot 52. Beneath flange 50 is an externally threaded collar 53. Flange 50 and collars 52 and 53 are all formed of a single piece of metal, such as brass, having a central bore accommodating the lower end of core tube 12. The bore is of two different diameters, and as shown in FIGS. 3 and 7, the lower end of core tube 12 is stepped radially outwardly at 54 to conform to the shape of the bore in mounting member 13. At its lowermost end, core tube 12 is formed with an outwardly projecting flange 55 overlying the lower end of collar 53. Core tube 12 is press fit into mounting member 13 so that the two are permanently joined together.

Figure 1:
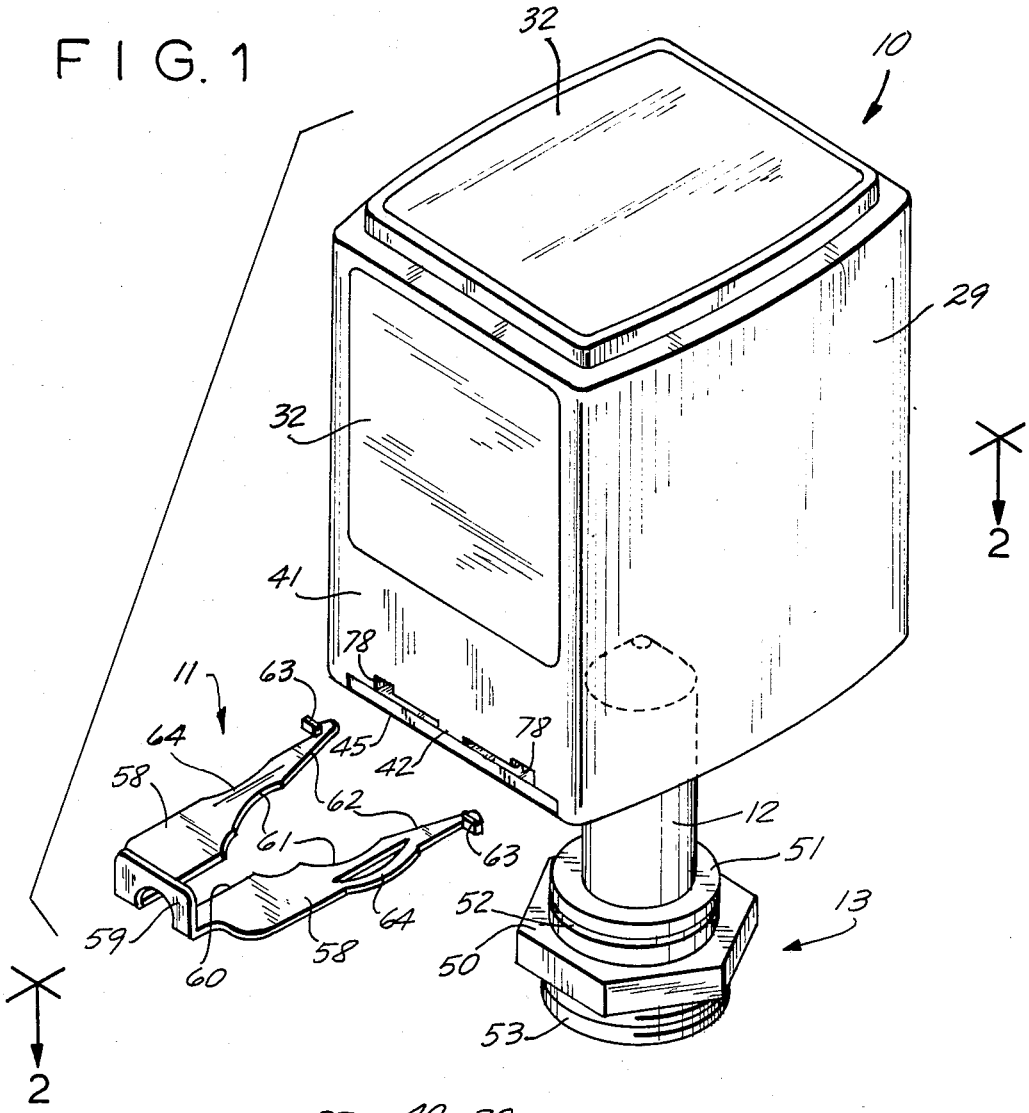
FIG. 1 is an exploded perspective view of an encapsulated solenoid coil, core tube mounting member, and spring clip fastener according to the present invention.
Figure 2:
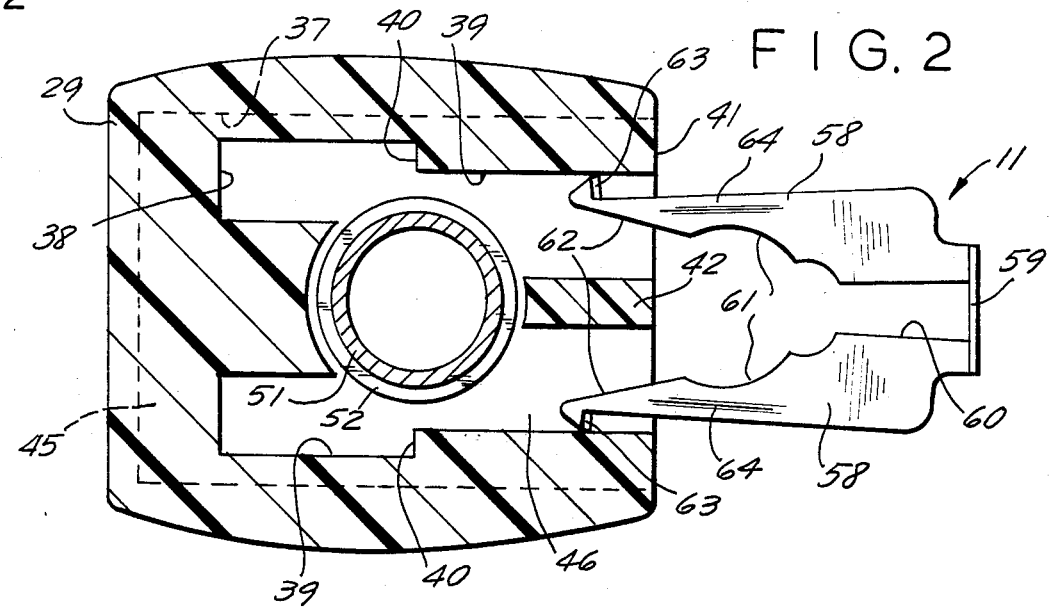
FIG. 2 is a cross-sectional view taken along line 2—2 of FIG. 1.

Fastener 11 is formed of an initially flat piece of springy sheet metal, such as stainless steel. Fastener, or spring clip, 11 has a generally U-shape defining two arms 58 joined at their rear ends by a bridge 59 (FIGS. 1 and 2). Bridge 59 is preferably bent at a right angle to the plane containing arms 58. Extending forwardly from bridge 59, between arms 58, is a generally rectangular slot 60 which at its forward end expands into a wider slot defined by opposed arcuate edges 61 of arms 58. From edges 61, the opposed edges 62 of arms 58 diverge forwardly. At its free end, each arm is formed with an outwardly extending lug 63, each lug being formed of a bent-up piece of metal so that it has a thickness greater than the thickness of the fastener arms 58. Each arm 58 has a bowed strand 64 struck out of the plane of the arm, the strand defining a resilient detent having resilience in a direction perpendicular to the plane of the arm.

Fastener 11 is used to join together encapsulated coil 10 and mounting member 13 after the latter has been secured to a device to be controlled by the solenoid actuator.

The solenoid actuator according to this invention may be used to operate a wide variety of devices. An example of such devices is the valve 66 shown in FIG. 7. Valve 66 includes a valve body 67 having a fluid inlet port 68, a fluid outlet port 69, and a valve seat 70 between those ports. At its upper end, valve body 66 is formed with an internally threaded bore 71 into which externally threaded collar 53 of mounting member 13 is threaded so as to join mounting member 13 to valve body 66. A suitable seal (not shown) is employed to insure a fluid-tight connection between mounting member 13 and valve body 66.

Prior to assembling mounting member 13 with valve body 66, a movable armature 72 is inserted into core tube 12 for axial sliding movement within the core tube. The lower end of armature 72 carries a valve element 73 of resilient material adapted to cooperate with valve seat 70. In FIG. 7, coil 17 is deenergized, and hence a spring 74 holds valve disk 73 against valve seat 70 to close the valve. When coil 17 is energized, armature 72 rises within core tube 12 to close the gap shown between the top of armature 72 and the top wall of core tube 12, thereby lifting valve disk 73 off the valve seat 48 to open the valve.

As shown in FIGS. 3 and 7, stationary armature 22 is formed with a frusto-conical depression 77, and the upper end of core tube 12 is formed with a frusto-conical shape which fits into depression 77. This cooperation helps to insure coaxial positioning of the core tube within coil 17. Movable armature 72 is also formed at its upper end with a frusto-conical shape corresponding to that of the upper end of core tube 12.

When encapsulated coil 10 and fastener 11 are originally made, they are of course separate elements. Fastener 11 is assembled with encapsulation 29 (including plate 45) by inserting the ends of arms 58, which carry lugs 63, into slideway chamber 46. As shown in FIG. 1, the entrance to the slideway chamber, at the rear face 41 of encapsulation 29, is formed with two channels 78 which slidably accommodate lugs 63. It will be appreciated that the presence of channels 78 insures that fastener 11 can be inserted into the slideway chamber only in the orientation shown in FIG. 1. In other words, if fastener 11 were rotated 180° about a horizontal axis, it could not be inserted into the chamber 46 because the lugs 63 would be projecting downwardly, and these lugs must project upwardly to fit through channels 78.

The distance between walls 39 of depression 38, at the entrance end of chamber 46, is slightly less than the distance between the outer edges of lugs 63 when fastener 11 is in its unstressed condition. As a result, in order to insert fastener 11 into chamber 46, arms 58 of the fastener must be pressed slightly toward each other, as shown in FIG. 2. The fact that arms 58 have been pressed toward each other is indicated by the fact that in FIG. 2 slot 60 is not perfectly rectangular, but rather slightly trapazoidal.

Figure 4:
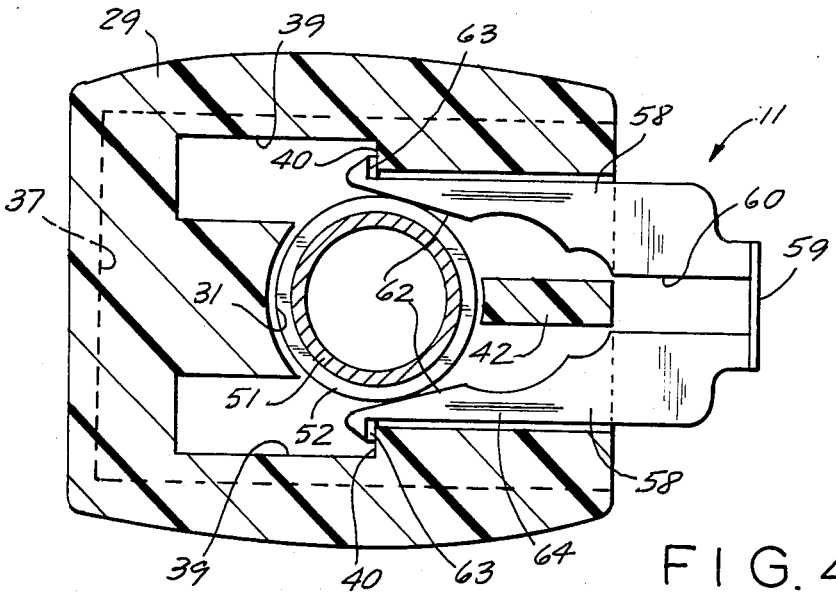
FIG. 4 is a cross-sectional view taken along line 4—4 of FIG. 3.

After insertion of fastener 11 into the entrance of chamber 46, it is pushed inwardly until lugs 63 move just beyond shoulders 40 (FIGS. 3 and 4). At this point, arms 58 spring away from each other and lugs 63 move in front of shoulders 40. It will be appreciated that the cooperation between lugs 63 and shoulders 40 prevents extraction of fastener 11 from chamber 46. In this way, fastener 11 is effectively permanently associated with encapsulated coil 10.

After mounting member 13, carrying core tube 12, is secured to valve body 66, by threading collar 53 into bore 71, encapsulated coil 10, carrying fastener 11, is assembled with the mounting member. Fastener 11 will be in the position shown in FIGS. 3 and 4, with lugs 63 directly adjacent to shoulders 40. Encapsulated coil is slipped over core tube 12, so that the core tube slides through sleeve 23 toward stationary armature 22. At this point, as shown in FIG. 4, diverging edges 62 of fastener arms 58 are adjacent to annular slot 52 in mounting member collar 51. In addition, the top of core tube 12 is spaced from depression 77 in stationary armature 22, and the top surface of flange 50 is spaced from the lower surface of plate 45.

In order to join encapsulated coil 10 to mounting member 13, fastener 11 is pushed further inwardly (see FIGS. 5 and 6). This movement is guided by entry of rib 42 into slot 60. Diverging edges 62 of arms 58 engage the inner, annular wall of slot 52 and cause arms 58 to be spread slightly, as shown in FIG. 6. At the same time, the portion of each arm 58 adjacent to spring detent 64 enters annular slot 52. Each spring detent 64 slides along the inner surface of plate 45, as shown in FIG. 5.

Figure 9:
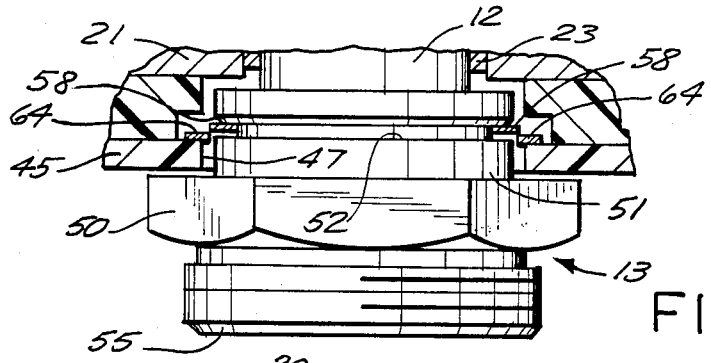
FIG. 9 is a fragmentary cross-sectional view taken along line 9—9 of FIG. 8.

To complete the assembly, fastener 11 is pushed fully into slideway chamber 46 (see FIGS. 7, 8, and 9). At this point, arcuate edges 61 of fastener arms 58 become coaxial with mounting member 13, and hence the arms spring toward each other so that arcuate edges 61 are close to or engage the inner, annular wall of slot 52. During this movement of fastener 11 from the position shown in FIG. 5 to the position shown in FIG. 7, spring detents 64 continue to slide along the inner face of plate 45. The downward pressure of detents 64 against the inner face of plate 45 causes an upward lifting force of arms 58 against the upper surface of slot 52 (see FIG. 9). This upward pressure causes movement of core tube 12 further into coil 17 so as to bring the upper frusto-conical surface of the core tube into engagement with the depression 77 in stationary armature 22. At the same time, flange 50 of mounting member 13 is brought closer to the bottom surface of plate 45 (compare FIG. 3 and FIG. 7). It will be appreciated that in order for fastener 11 to perform the function of urging core tube 12 further into coil 17, the fastener must be oriented as shown in FIG. 7. It is for this reason that the entry portion of chamber 46 is formed with channels 78, which cooperate with lugs 63, so as to insure that the fastener is inserted properly into the slideway chamber.

It will be seen that encapsulated coil 10 has been secured to mounting member 13, and hence to valve 66, without the use of any tools. Encapsulated coil 10 carried fastener 11 so that the latter is movable between an unlatched condition, shown in FIG. 4, and a latched condition, shown in FIG. 8. However, fastener 11 is never removed from slideway chamber 46, and hence is always available for performing its fastening function.

It should be mentioned that because of the cylindrical nature of collar 51, and slot 52, and the fact that the arms 58 of fastener 11 can engage slot 52 at any point around its circumference, there is no particular angular orientation which coil 10 must assume with respect to mounting member 13 in order to permit assembly of the encapsulated coil with the mounting member. Furthermore, after assembly, the encapsulated coil is freely rotatable with respect to mounting member 13. Consequently, the coil terminals 34 can be oriented in the most convenient direction for connection to the power supply.

After the parts are assembled, as shown in FIG. 7, it may happen that coil 17 fails for some reason, and must be replaced. In such a case, it is merely necessary to pull fastener 11 outwardly, using bridge 59 as a grip, from its position shown in FIG. 8 to its position shown in FIG. 4. In this way, the edges of fastener arms 58 move out of slot 52 in the mounting member. Encapsulated coil 10 is then lifted off mounting member 13, a fresh encapsulated solenoid is put in its place upon core tube 12 and mounting member 13, and the fastener 11 of the fresh solenoid is pushed inwardly to the position shown in FIG. 8 to join the encapsulated coil and mounting member.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A solenoid actuator comprising:

a coil of electrically conductive wire wound about an axis, an enclosure for the coil, receptacle means carried by the enclosure for accommodating a mounting member of a device to be controlled by the solenoid actuator, a slideway carried by the enclosure extending transverse to the coil axis, a fastener movable within the slideway between a latched position in which it can engage the mounting member, to secure the enclosed coil to the device to be controlled, and an unlatched position in which it is disengaged from the mounting member, to permit separation of the enclosed coil from the device to be controlled, and means for preventing separation of the fastener and the enclosure when the fastener is in its unlatched position.

2. A solenoid actuator as defined in claim 1 wherein the enclosure is a plastic encapsulation, the receptacle means is an opening in a surface of the encapsulation, and the slideway is a chamber within the encapsulation intersecting the recess.

3. A solenoid actuator as defined in claim 1 including a mounting member of a device to be controlled, the mounting member having a recess located in a plane transverse to the coil axis, and the fastener having a portion sized to enter the recess when the fastener is moved to its latched position.

4. A solenoid actuator as defined in claim 3 wherein the interior of the coil is at least partially hollow and the receptacle means is an opening in the enclosure aligned with the hollow interior of the coil, and including a core tube slidably accommodated within the interior of the coil, one end of the core tube being secured to the mounting member.

5. A solenoid actuator as defined in claim 4 including a stationary armature within the interior of the coil, the armature having a surface facing the receptacle means, and resilient means carried by the fastener for urging the other end of the core tube against said surface of the stationary armature in response to entry of said fastener portion into the mounting member recess.

6. A solenoid actuator as defined in claim 1 wherein the fastener is a generally U-shaped clip slidable axially within the slideway, the arms of the clip being arranged at opposite sides of the receptacle means when the clip is in its latched position.

7. A solenoid actuator as defined in claim 1 including a mounting member of a device to be controlled, the mounting member having slot means located in a plane transverse to the coil axis, and wherein the fastener is a generally U-shaped clip, the mounting member being between the arms of the clip and the arms of the clip being within the slot means when the clip is in its latched position.

8. A solenoid actuator as defined in claim 7 wherein the mounting means has a cylindrical portion, the slot means being an annular slot extending completely around the cylindrical portion, and the inner edges of the arms of the clip being arcuate shaped for cooperation with the slot.

9. A solenoid actuator as defined in claim 1 wherein the preventing means includes a lug projecting from the fastener in a direction transverse to the direction of movement of the fastener between its latched and unlatched positions, and a shoulder in the slideway located in the path of movement of the lug and engageable by the lug when the fastener reaches its unlatched position, whereby complete withdrawal of the fastener from the slideway is prevented.

10. A solenoid actuator as defined in claim 1 wherein the enclosure is a plastic encapsulation, the slideway is a chamber within the encapsulation, and the fastener is a clip formed of sheet metal slidable within the chamber.

11. A solenoid actuator as defined in claim 10 wherein the slideway chamber has an entry opening at one face of the encapsulation, and including a lug projecting from the clip out of the plane of the clip, the entry opening being shaped to permit passage of the lug into the chamber only when the clip is in a single orientation with to the enclosure.

* * * * *